United States Patent [19]

Uritis

[11] 4,120,464

[45] Oct. 17, 1978

[54] TAKE-UP ROLL MECHANISM

[75] Inventor: Joseph M. Uritis, Chagrin Falls, Ohio

[73] Assignee: Gould Inc., Rolling Meadows, Ill.

[21] Appl. No.: 856,833

[22] Filed: Dec. 2, 1977

[51] Int. Cl.[2] ..... B65H 75/24

[52] U.S. Cl. ..... 242/72 R; 242/74

[58] Field of Search ..... 242/72 R, 74, 74.1, 242/74.2, 68.4

[56] References Cited

U.S. PATENT DOCUMENTS

| | | | |
|---|---|---|---|
| 2,066,568 | 1/1937 | Jones | 242/72 |
| 2,454,984 | 11/1948 | Bader | 242/72 |
| 3,016,212 | 1/1962 | Marcus | 242/72 |
| 3,016,212 | 1/1962 | Marcus | 242/74.1 X |
| 3,863,857 | 2/1975 | Smith | 242/74.1 |

*Primary Examiner*—Edward J. McCarthy

*Attorney, Agent, or Firm*—Charles E. Snee, III; Edward E. Sachs

[57] ABSTRACT

An improved take-up roll mechanism for strip matarial such as paper comprises a central tube on which the paper is wound, the tube having a longitudinal slot through its wall and clamping elements located within the tube which grip the strip material when the tube is expanded by its support hubs. A quick-release mechanism is also disclosed.

7 Claims, 9 Drawing Figures

TAKE-UP ROLL MECHANISM

BACKGROUND OF THE INVENTION

In various arts, such as the strip recorder art and others, practioners often are confronted with a need to wind a length of strip or sheet material onto a spool or bobbin. In such cases, the abilities to quickly and reliably thread the spool when a length of strip is to be wound and to easily remove the wound strip from the spool when winding has been completed, are particularly important. The prior art discloses numerous attempts to provide spools or roller mechanisms which satisfy these requirements; however, for various reasons, devices known to the applicant have proven to be unsatisfactory. For example, many prior art devices comprise complex linkages for gripping the strip of material, which make assembly and disassembly difficult. Others require that the spool roll open outwardly to release the strip so that the roll cannot be removed from a wound strip of material.

OBJECTS OF THE INVENTION

An object of the invention is to provide an improved take-up roll mechanism for winding strip material such as paper from a recorder or printer-plotter.

A further object of the invention is to provide such a mechanism with the very simple means for gripping the leading end of the strip during winding.

Yet another object of the invention is to provide such a mechanism in which the roll supporting the strip material may be easily removed from the wound material following winding.

A still further object of the invention is to provide such a mechanism in which the roll supporting the strip material is easily installed in and removed from the device without requiring any disassembly.

These objects of the invention are given only for example; thus, other desirable objects and advantages inherently achieved by the disclosed apparatus may occur to those skilled in the art. Nonetheless, the scope of the invention is to be limited only by the appended claims.

SUMMARY OF THE INVENTION

The above objects and other important advantages are achieved by the apparatus according to the present invention. Means are provided for winding a strip of thin material such as paper leaving a recorder or printer-plotter, which include a cylinder of thin walled resilient material having a longitudinally extending slit through the wall of the cylinder. The cylinder is supported for rotation in an appropriate housing and means are provided for expanding the cylinder radially as the cylinder is mounted within its support and for allowing the cylinder to contract as it is removed from its support. Located within the cylinder are resilient gripping or clamping means which move into contact with the strip of thin material as the cylinder is expanded radially and subsequently moved out of contact with the material as the cylinder is allowed to contract. To facilitate expanding and contracting the cylinder, its mounting hubs are provided with conical support surfaces which extend axially into the cylinder in use so that as the conical surface is driven into or removed from the cylinder, the cylinder will expand or retract respectively. Finally, a convenient linkage is provided for quickly engaging and disengaging the conical support hubs from the support cylinder.

DETAILED DESCRIPTION OF THE PREFERRED EMBODIMENT

Figure 1:
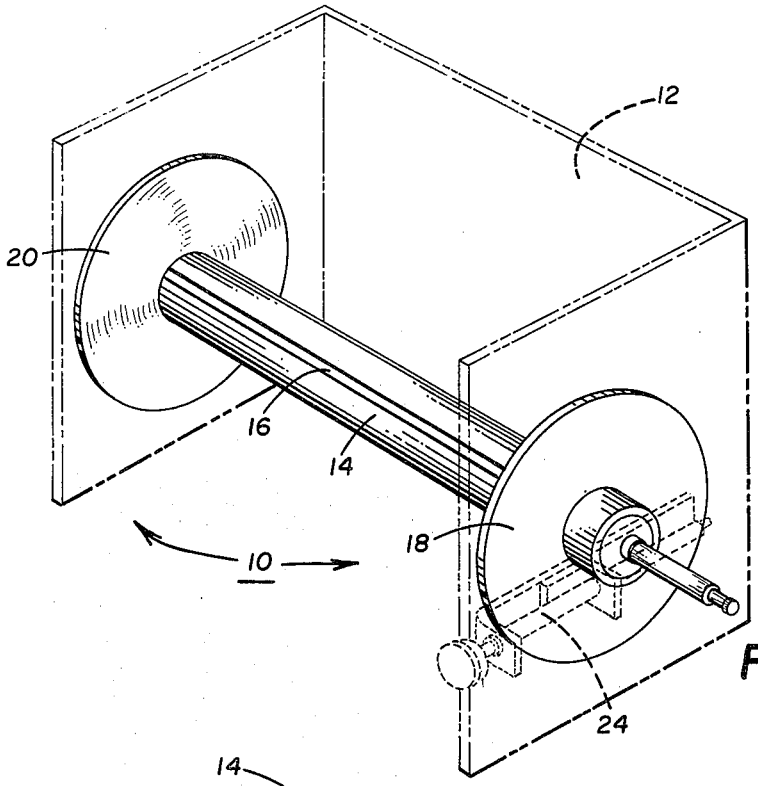
FIG. 1 shows a perspective view, partially in phantom, of a take-up mechanism according to the present invention.

There follows a detailed description of the preferred embodiment of the invention, reference being made to the drawings in which like reference numerals identify like elements of structure in each of the several figures.

With reference to FIG. 1, a take-up mechanism according to the invention, generally indicated by reference numeral 10, comprises a U-shaped support housing 12, shown in phantom, which supports between its arms a cylinder or roll 14 made of thin walled resilient material such as spring steel or other suitable material. A longitudinally extending slit 16 is provided through the thin wall of cylinder 14 to permit insertion of a strip of thin material such as paper into the interior of the cylinder. A mounting hub 18 and a driven hub 20 are provided at either end of the mechanism in position to support cylinder 14. An actuating mechanism 24, shown in phantom, is positioned on the exterior of housing 12 to facilitate mounting cylinder 14 within the housing. As will be subsequently discussed, the cooperation of mechanism 24 and hubs 18 and 20 causes cylinder 14 to expand and contract to grip and release a strip of thin material.

Figure 2:
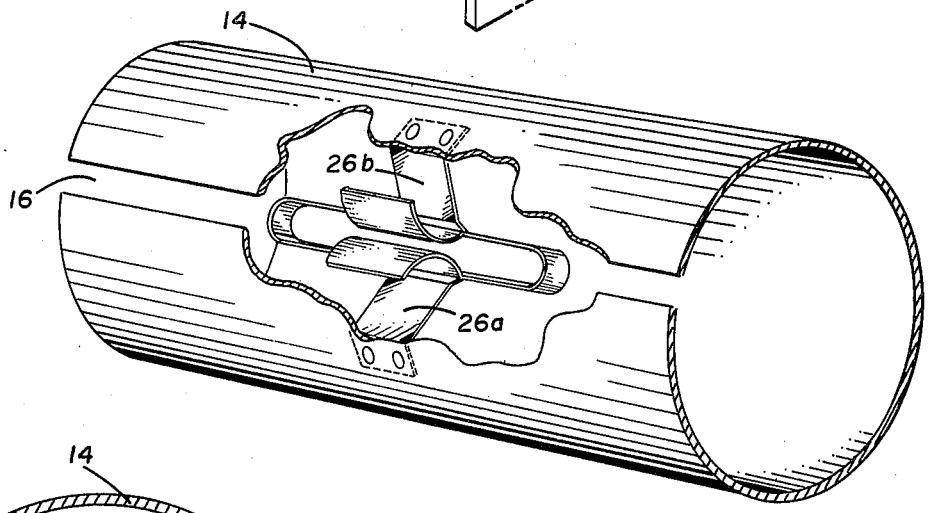
FIG. 2 shows a perspective view, partially broken away, through a longitudinal slot in support tube of the invention, illustrating the resilient gripping means which hold a strip of material during use of the invention.
Figure 3:
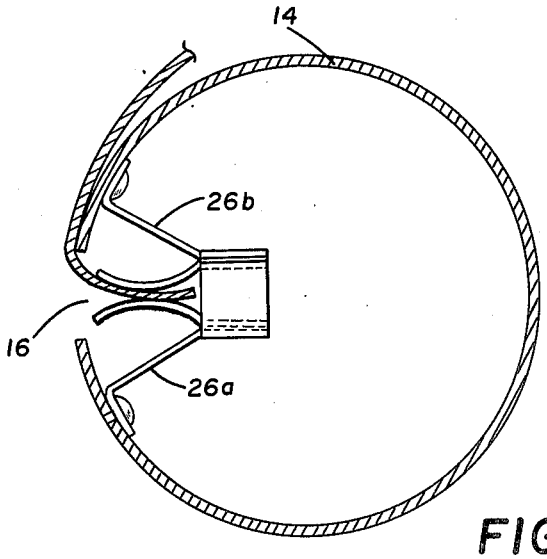
FIG. 3 shows a view taken from the right side of FIG. 2, as illustrated, looking down the centerline of the support tube and illustrating how a strip of material cooperates with the resilient gripping means.
Figure 4:
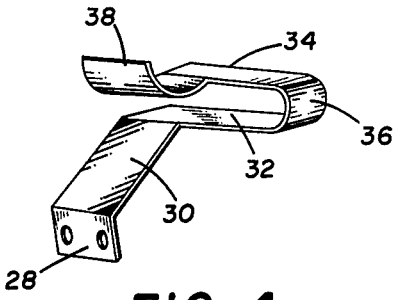
FIG. 4 shows a perspective view of a resilient gripping element, according to the invention.

Referring now to FIGS. 2, 3 and 4, the details of the cylinder 14 may be understood. Cylinder 14 encloses a pair of internal, resilient gripping clips 26*a*, 26*b* which are positioned to grasp a strip of thin material as indicated schematically in FIG. 3. Each gripping clip comprises a mounting foot 28 which is secured to the inner wall of the cylinder 14 by means such as rivets or screws. A leg 30 extends essentially radially inwardly from the mounting foot 28 and terminates at an axially extending spring arm 32 which is integral with leg 30. Spaced from spring arm 32 is an oppositely extending spring arm 34 which doubles back over spring arm 32 and is joined to spring arm 32 by a cylindrical spring portion 36. At approximately the position on oppositely extending spring arm 34 just above the inner end of leg 30, a resilient gripping finger 38 extends laterally from spring arm 34. FIG. 4 shows one of the resilient gripping clips 26*a*, 26*b* in perspective, there being at least two of such clips mounted within cylinder 14 on opposite sides of longitudinal slit 16, as illustrated in FIGS. 2 and 3. The clips are positioned so that their resilient gripping fingers 38 are opposed to each other in position to grip a strip of material inserted therebetween. Due to the geometry of the gripping clips and their location on either side of longitudinal slit 16, the resilient gripping fingers of each clip will be drawn toward each other as cylinder 14 is expanded. This movement may be most readily understood by inspection of FIG. 3. In practice, a tempered phosphorus bronze material has been found to be preferable for clips 26*a*, 26*b*; however, those skilled in the art will appreciate that other resilient materials may be used without departing from the scope of the present invention. Also, although single clips on either side of slit 16 have been illustrated, it should be understood that additional clips may be provided and that each individual clip may have more than one resilient gripping finger.

Figure 5A:
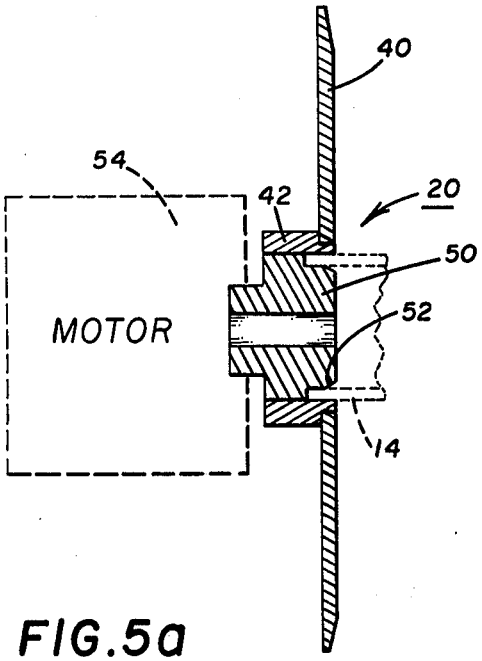
FIGS. 5 and 5*a* show the mounting and drive hubs for the take-up mechanism, indicating their unique cooperation with the support tube.
Figure 5:
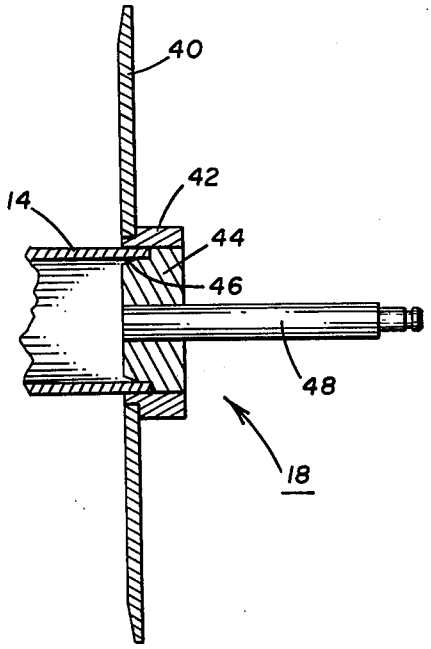

FIGS. 5 and 5*a* show the structural details of mounting hub 18 and driven hub 20. Both hub 18 and hub 20 comprise a radially extending flange 40 which serves to confine the edges of a strip of material as the strip is wound and a flange hub 42 which supports flange 40. As shown in FIG. 5, hub 18 further comprises an axially movable expansion hub 44 which is rigidly attached to the inside diameter of flange hub 42. Expansion hub 44 comprises a conical surface 46 which is recessed below the inner surface of flange 40, as illustrated. Finally, an actuator shaft 48 extends from expansion hub 44 a distance suitable for interaction with the actuating mechanism shown in FIGS. 6, 6*a* and 6*b*. FIG. 5*a* shows that driven hub 20 comprises an axially stationary driven hub 50 which also includes a conical surface 52. Driven hub 50 is operably connected to a source of power such as a motor 54, shown in phantom. As illustrated in FIG. 1, hubs 18 and 20 are axially aligned, so that their conical portions 46 and 52 are positioned to receive the inside diameter of cylinder 14 when the take-up mechanism is actuated.

Figure 6B:
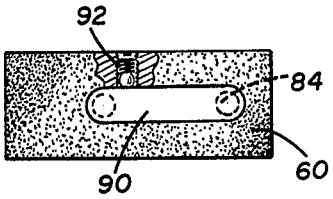
FIGS. 6, 6*a* and 6*b* show top, side and partial front views, respectively, of the actuating mechanism used to secure the strip material and support roll in the device.
Figure 6:
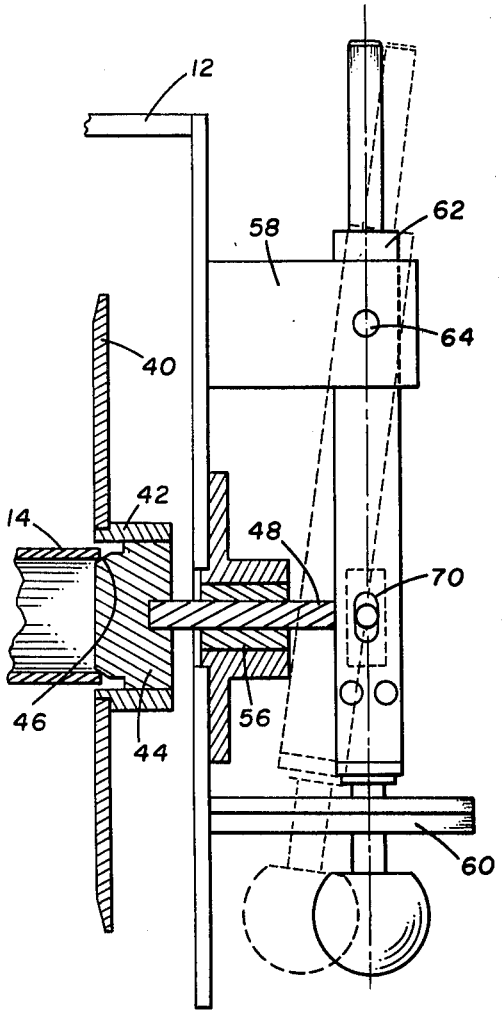
Figure 6A:
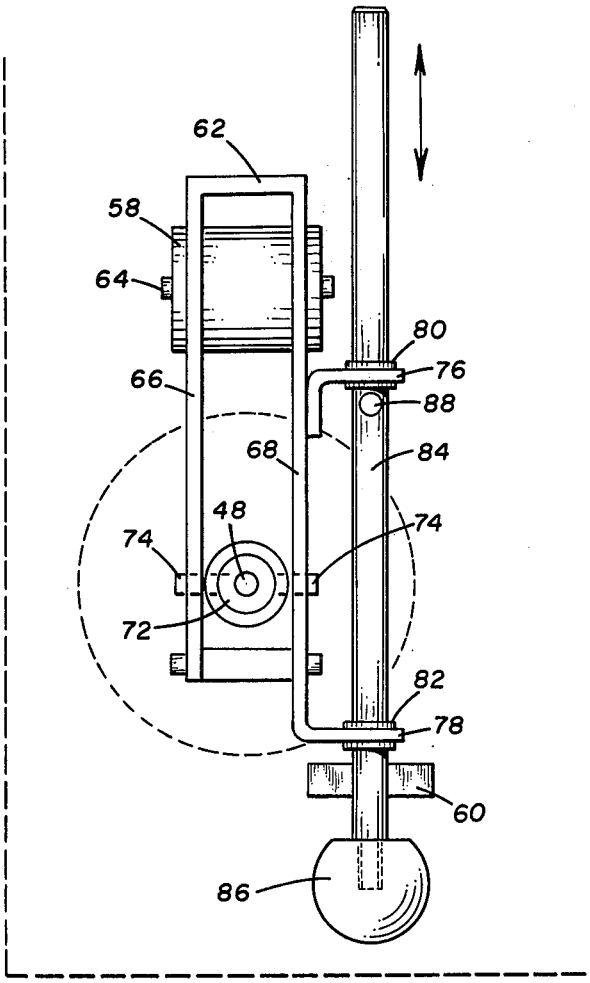

Turning now to FIGS. 6, 6*a*, and 6*b*, the details of actuating mechanism 24 may be understood. Shaft 48 extends from expansion hub 44 through the wall of housing 12 and is rotatably supported at the exterior of housing 12 by a suitable bearing 56 or the like. Bearing 56 also permits axial movement of shaft 48. A pair of spaced support brackets 58, 60 extend laterally from housing 12. Bracket 58, which is essentially U-shaped in configuration, pivotably supports an arm 62 on a simple pivot 64. Arm 62 comprises spaced side wall elements 66, 68. At the ends of arms 66, 68, a pair of opposed axial slots 70 is provided. The outer end of shaft 48 turns in a simple bushing or bearing 72 which includes a pair of radially extending fingers or pins 74 which ride in slots 70. Arm 68 further comprises a pair of spaced, laterally extending tabs, 76, 78 having aligned bores therethrough. Bushings 80, 82 are located in the aligned bores to slidably receive an actuator rod 84. To facilitate use of actuator rod 84, it is provided with a gripping knob 86 at its outer end and a stop 88 along its length so that the rod may be moved in and out through bushings 80, 82 as desired during operation. Rod 84 also passes through a slot 90 in bracket 60, as shown in FIG. 6*b*. To retain rod 84 in its engaged, lefthand position as viewed in FIG. 6*b*, a detent or other suitable locking device 92 is provided in the wall of slot 90.

In operation, the device is loosely assembled as shown in FIG. 1 with actuating rod 84 in its solid line position as illustrated in FIG. 6. In this orientation, the opposite ends of cylinder 14 will just contact the outer ends of conical surfaces 46 and 52. The strip of thin material is then inserted through slit 16 into the space between gripping fingers 38. Then, by moving actuator rod 84 to its phantom position as illustrated in FIG. 6, expansion hub 44 is moved to the left as illustrated thereby forcing the conical surfaces of both hubs to extend into the interior of cylinder 14. This causes the cylinder to expand so that the gripping fingers 38 are forced into contact with the strip of material thereby holding it in place for subsequent operation. Motor 54 may then be actuated as needed to wind the material on cylinder 14. When the desired length of material has been wound on cylinder 14, motor 54 is stopped. Actuator rod 84 is then moved to a righthand position just beyond that illustrated in FIG. 6 so that the conical surface 46 is withdrawn from the cylinder 14, thereby permitting the cylinder 14 to contract and release the end of the strip of material. The roll of paper or other material may be removed easily from the take-up mechanism and cylinder 14 removed from the roll by simply sliding it out of the center of the roll. Cylinder 14 may then be returned to its position as illustrated in FIG. 1 thereby readying the device for immediate reuse.

Having described my invention in sufficient detail to enable those skilled in the art to make and use it, I claim:

1. Improved apparatus for winding a strip of thin material, comprising:
   - a cylinder of thin-walled resilient material;
   - longitudinally extending slit through the wall of said cylinder;
   - means for supporting said cylinder for rotation about its axis;
   - means cooperating with said supporting means for expanding said cylinder radially as said supporting means is engaged with said cylinder and for allowing said cylinder to contract as said supporting means is disengaged;
   - means cooperating with said cylinder for gripping a strip of thin material inserted through said slit as said cylinder is expanded radially and for releasing such a strip of thin material as said cylinder is allowed to contract.

2. Apparatus according to claim 1, wherein said slit is parallel to the axis of said cylinder.

3. Apparatus according to claim 1, wherein said means for expanding and contracting said cylinder comprises at least one hub rotatably mounted on said supporting means, said hub having a conical surface positioned for insertion axially into said cylinder whereby said cylinder is expanded as it moves over said conical surface; and means for inserting said conical surface into and removing said conical surface from said cylinder whereby said cylinder respectively is expanded and contracted.

4. Apparatus according to claim 3, wherein said at least one hub has a shaft mounted for linear movement on its axis of rotation; and said means for inserting and removing said conical surface comprises an actuator rod pivotably mounted to said supporting means and connected to said shaft whereby said shaft and said hub undergo axial movement to insert and remove said conical surface.

5. Apparatus according to claim 4, further comprising means for releasably securing said actuator rod in its position where said conical surface has been inserted into said cylinder.

6. Apparatus according to claim 1, wherein said gripping means comprises at least one pair of resilient clip elements, one member of the pair mounted on each side of said slit within said cylinder, each clip element having at least one gripping surface oriented to face the corresponding gripping surface of the other member of the pair, whereby as said cylinder is expanded said gripping surfaces contact opposite sides of a strip of thin material inserted through said slit.

7. Apparatus according to claim 1, wherein said means for expanding and contracting said cylinder comprises at least one hub rotatably mounted on said supporting means, said hub having a radially extending flange for axially containing strip material as it is wound on said cylinder and a conical surface recessed below the surface of said flange and positioned for insertion axially into said cylinder whereby said cylinder is expanded as it moves over said conical surface.

* * * * *